United States Patent [19]

Bernhardt

[11] Patent Number: 5,002,276

[45] Date of Patent: Mar. 26, 1991

[54] BOWLING BALL FINGER INSERT

[75] Inventor: David A. Bernhardt, Utica, Mich.

[73] Assignee: Davalor Mold Corporation, Mount Clemens, Mich.

[21] Appl. No.: 498,009

[22] Filed: Mar. 23, 1990

[51] Int. Cl.[5] ..... A63B 43/02

[52] U.S. Cl. ..... 273/63 A; 273/63 B

[58] Field of Search ..... 273/63, 64, 65 EG

[56] References Cited

U.S. PATENT DOCUMENTS

| | | | |
|---|---|---|---|
| 189,674 | 4/1877 | Woods | 273/63 A |
| 447,011 | 2/1891 | Harman | 273/63 A |
| 580,207 | 4/1897 | Boemermann et al. | 273/63 A |
| 626,584 | 6/1899 | Wilmerling | 273/63 A |
| 673,688 | 5/1901 | Pickett | 273/63 A |
| 950,838 | 3/1910 | Cavanagh | 273/63 A |
| 2,273,199 | 2/1942 | Hilton et al. | 273/63 A |
| 2,460,385 | 2/1949 | Hausman | 273/63 A |
| 2,646,985 | 7/1953 | Nagy et al. | 273/63 A |
| 2,708,578 | 5/1955 | Mitchell | 273/63 A |
| 2,843,382 | 7/1958 | Ross | 273/63 A |
| 3,774,909 | 11/1973 | Linden | 273/63 A |
| 3,784,198 | 1/1974 | Bach | 273/63 A |
| 3,804,412 | 4/1974 | Chetirko | 273/63 A |
| 4,247,102 | 1/1981 | Seyler | 273/63 B |
| 4,265,642 | 5/1981 | Mir et al. | 55/85 |
| 4,289,312 | 9/1981 | Heimbigner | 273/63 A |
| 4,358,112 | 11/1982 | Straborny | 273/63 A |
| 4,381,863 | 5/1983 | Norman | 273/63 A |
| 4,416,452 | 11/1983 | Heimbigner | 273/63 A |
| 4,432,546 | 2/1984 | Allen, Jr. | 273/63 A |
| 4,530,502 | 7/1985 | Yamane | 273/63 A |
| 4,560,162 | 12/1985 | Miller | 273/63 B |
| 4,561,654 | 12/1985 | Haza | 273/63 B |
| 4,569,520 | 2/1986 | Yamane | 273/63 A |
| 4,585,230 | 4/1986 | Martin | 273/63 A |
| 4,623,149 | 11/1986 | Herman | 273/63 A |
| 4,699,380 | 10/1987 | Mace | 273/63 A |
| 4,773,645 | 9/1988 | Todd et al. | 273/63 A |
| 4,778,178 | 10/1988 | Haza | 273/63 B |

OTHER PUBLICATIONS

Advertisement by Pro Sports Systems, Inc., Entitled "Manufactures of the Grips that Legends Use." Publication Date Unknown, but prior to 3-23-90.

*Primary Examiner*—George J. Marlo

*Attorney, Agent, or Firm*—Harness, Dickey & Pierce

[57] ABSTRACT

A finger hole insert for a bowling ball which is formed of a resilient tubular body and is adapted to be inserted into a finger hole. The insert has a generally cylindrical inner wall surface defining first and second finger openings at opposite terminal ends of the insert which are sized to permit insertion of a bowler's finger therein. The first finger opening has a thickened finger pad therein adapted for cushioning the bowler's finger. The second finger opening has a plurality of ribs extending in longitudinal spaced relationship around its inner periphery adapted to augment the spin and lift applied during delivery of the bowling ball. In this manner, the bowler has a preferential choice between the function provided by each finger opening of the insert.

26 Claims, 1 Drawing Sheet

BOWLING BALL FINGER INSERT

BACKGROUND AND SUMMARY OF THE INVENTION

The present invention relates generally to tubular inserts for a bowling ball and, more particularly, to an improved finger grip insert adapted to be inserted into a finger hole of a bowling ball to enhance a bowler's grip of the ball during delivery.

In bowling, it is the object of the bowler to knock down as many pins as possible. Many successful bowlers throw a ball which has a pronounced hook since, historically, this type of delivery generates the most pin action. To make a ball hook, it is necessary to maintain contact between the fingers and the ball during delivery to impart a "lifting" action on the ball.

Finger hole inserts are used by bowlers to augment the lift and spin imparted to the ball during release. Likewise, some finger hole inserts are designed to provide the bowler with greater control (i.e. "feel") of the ball. In general, finger inserts allow the bowler's fingertips to stay in contact with the ball while providing a desired function such as enhancing the "feel" or adding "lift" to the bowler's delivery.

Various tubular finger inserts are known in the art. However, conventional finger inserts typically provide a single function (i.e. extra "lift") and are generally configured to have only one open end.

Accordingly, it is a primary object of the present invention to provide a "dual function" reversible finger insert which offers the bowler a choice between two distinct functional characteristics. The improved finger grip insert of the present invention has first and second finger openings provided at opposite ends thereof. The first finger opening has at least one ridge-like projection which enables the bowler to add "lift" and "spin" to his delivery of the bowling ball. The second finger opening has a tapered finger pad to permit the bowler to enjoy improved "feel" of the bowling ball by increasing the contact area between the bowler's finger and the insert. In this manner, depending on the bowler's preference, the insert is reversible so that either one of the two ends may be used by the bowler.

It is another object of the present invention to provide a injection molded finger hole insert which is economical to manufacture and is simple in construction. The aforementioned invention may be permanently or removably secured within a finger hole of a bowling ball so as to permit preferential use of either "functional" end of the insert. The resilient finger insert is adapted for securement within a finger hole with either finger opening of the insert being substantially flush with the exterior bowling ball surface.

These and other objects, features and advantages of the present invention will become more apparent from the following description to one skilled in the art upon reading the following specification taken in connection with the accompanying drawings, which show, for purposes of illustration only, a preferred embodiment of the present invention.

DETAILED DESCRIPTION OF THE PREFERRED EMBODIMENT

Figure 1:
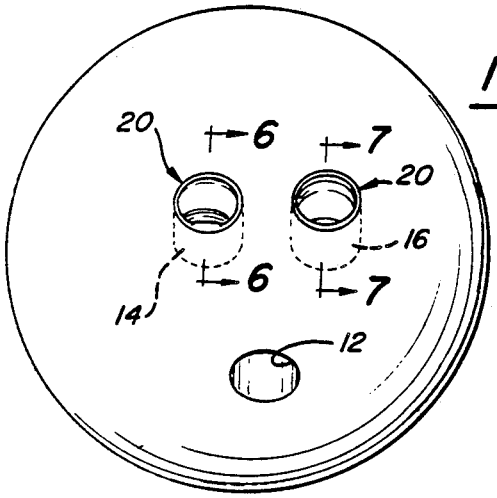
FIG. 1 is a plan view of a bowling ball incorporating improved finger inserts according to a preferred embodiment of the present invention.

Referring now to the drawings, FIG. 1 illustrates a bowling ball 10, having a thumb hole 12 and two finger holes 14 and 16. Finger holes 14 and 16 are shown having, secured therein, improved finger inserts 20 according to the teachings of the present invention. As is apparent, inserts 20 are secured within finger holes 14 and 16 so as to be below or substantially flush with the exterior surface of bowling ball 10. The preferred structure and function of inserts 20 will be shown and described in greater detail in connection with the remaining Figures.

Figure 2:
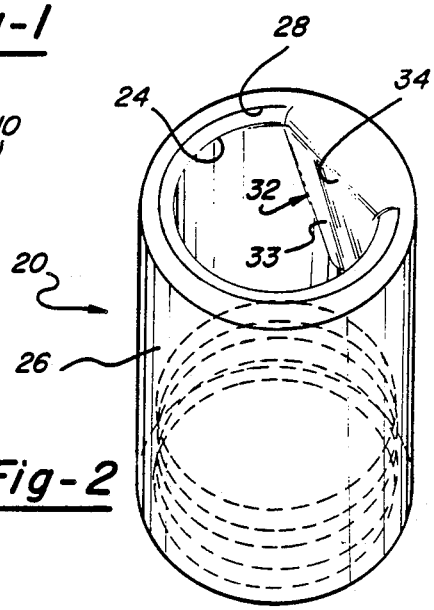
FIG. 2 is a perspective view of the improved finger insert.

FIG. 2 is a perspective view of finger insert 20. As illustrated, finger insert 20 is a tubular elongated cylindrical body. Preferably, finger insert 20 is an injection molded, right circular hollow body fabricated from a relatively resilient material such as silicon rubber or vinyl. However, it is to be understood, that any resilient material which provides suitable characteristics is within the fair scope of this invention.

Figure 3:
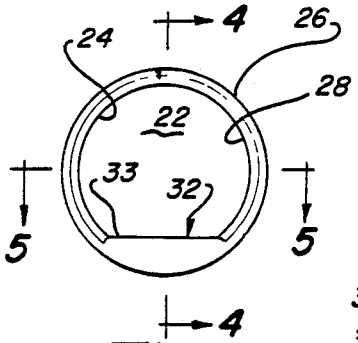
FIG. 3 is an end view of the improved finger insert of FIG. 2.
Figure 4:
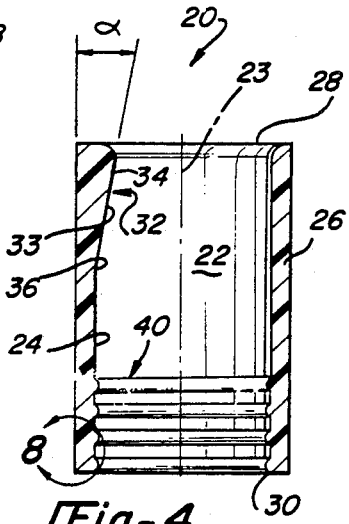
FIG. 4 is a cross-sectional view taken along line 4—4 of FIG. 3.
Figure 5:
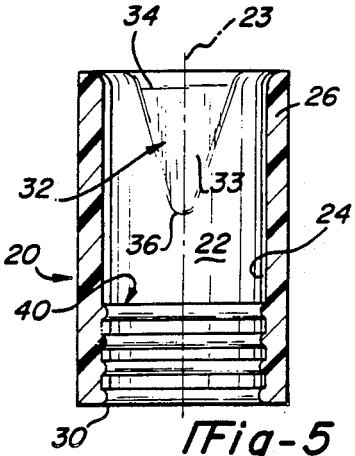
FIG. 5 is a cross-sectional view taken along line 5—5 of FIG. 3.

Insert 20 has an axially extending aperture or bore 22 which is concentric with a central axis 23 of insert 20 and which is provided to receive a bowler's fingertip therein. Bore 22 is, preferably, circular in cross-section and extends completely through insert 20. More specifically, bore 22 is defined by an inner wall surface 24 which is in substantially coaxial relation to outer wall surface 26 as seen in FIG. 3. Outer wall surface 26 is circular in cross-section and preferably has a relatively smooth surface texture. The wall portion formed between cylindrical outer wall surface 26 and cylindrical inner wall surface 24 is of a substantially constant thickness. Bore 22 extends completely through insert 20 to define a first finger opening 28 and a second finger opening 30 which are provided at opposite terminal ends thereof.

Referring now to FIGS. 4 through 8, the function and structure of insert 20 will be described in greater detail. Adjacent first finger opening 28 is a thickened "cushioning" surface 32 defining a finger pad. In general, a thickened portion of inner wall surface 24 defines finger pad 32 while the remainder of the wall portion adjacent and abutting finger pad 32 is cylindrical and of constant wall thickness. More specifically, finger pad 32 is generally triangular in configuration with its thickened base 34 located in close proximity to the planar terminal end of first finger opening 28. The apex 36 of the triangular finger pad 32 extends toward second finger opening 30 and terminates approximately midway through insert 20. The planar surface 33 of finger pad 32 is preferably tapered so as to terminate at apex 36 by blending into the constant thickness wall portion previously described. The thickness of finger pad 32 gradually decreases from its base 34 toward apex 36. Preferably, the tapered planar surface 33 of finger pad 32 has an angular taper ($\alpha$) of about 8° relative to outer wall surface 26.

Triangular finger pad 32 functions to enhance the "feel" and provide additional power to the bowler's delivery as a result of generating additional direct contact between the bowler's fingertip and inner wall surface 24 of finger insert 20. Finger pad 32 "guides" the release of the fingers from insert 20 while acting as a reference with respect to the bowler's fingers during gripping and releasing of bowling ball 10. Insert 20 is preferably inserted into a finger hole in bowling ball 10 such that the bowler's fingertips will be adjacent finger pad 32. In this manner, finger pad 32 minimizes slippage of the bowling ball during delivery.

The outside diameter of finger insert 20 is preferably uniform regardless of the bowler's finger size so that finger insert 20 may be fit interchangeably in a standardized finger hole. More specifically, most bowling balls are currently provided with finger holes of approximately 31/32" in diameter and drilled to a depth of about 1-⅛" to 1-⅜". By maintaining a uniform outside diameter of insert 20, the size of finger holes 14 and 16 can be standardized thereby minimizing problems associated with drilling finger holes. Finger insert 20 is preferably available in a set of several different sizes of bore 22 corresponding to preselected finger sizes. More preferably, bore 22 is available in increasing increments of about 1/32" from about 19/32" to about 29/32". Incremental changes in finger sizes are compensated for by increasing the constant wall thickness defined between outer wall surface 26 and inner wall surface 24. In this manner, regardless of size, the thickness of finger pad 32 relative to inner wall surface 24 is uniform for all inserts. It is to be understood that the insert of the present invention can be fabricated to any desired length or any bore diameter which is required to meet the demands of bowlers.

Figure 8:
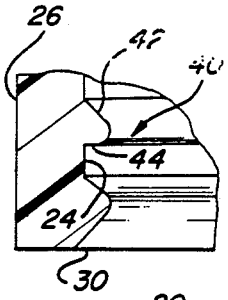
FIG. 8 is an enlarged view of a portion of FIG. 4.

In close proximity to the terminal end of second finger opening 30 at least two, and preferably four, ridge-like projections or ribs 40 are provided which extend around the periphery of inner wall surface 24. Preferably, ribs 40 are evenly spaced in longitudinal relation and are provided with a generally rounded contour. As shown in FIG. 8, ribs 40 are generally crescent-shaped being defined by a tapered major surface 42 and a rounded edge 44 which terminates at inner wall surface 24.

When finger insert 20 is installed in a finger hole such that second finger opening 30 is below or in generally flush relation to the external surface of bowling ball 10, a second "function" is provided as a preferential choice to the bowler. In practice, it has been found that the use of ridge-like projections 40 enhance the gripping force of the fingertip inserted within finger insert 20. Ribs 40 greatly increase the "lift" which may be applied to ball 10 by the bowler resulting in ball 10 generating a more pronounced hook. More particularly, the bowler's fingertips hook around the peripherally extending ribs to grip bowling ball 10. Likewise, ribs 40 minimize slippage of the bowling ball during delivery. The inner wall surface 24 at regions below ribs 40 is relatively smooth (i.e., not ridged) so that the frictional gripping action at these regions is the result of the frictional characteristic of the insert material. In this manner, a bowler may throw a more pronounced hook to generate increased pin action.

Figure 6:
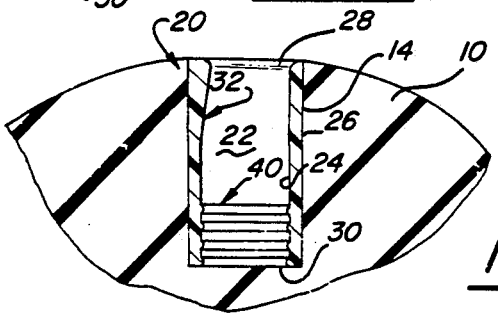
FIG. 6 is a cross-sectional view taken along line 6—6 of FIG. 1.
Figure 7:
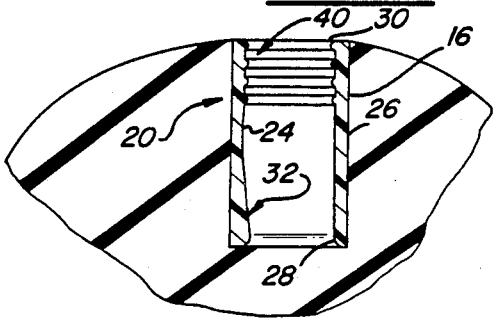
FIG. 7 is a cross-sectional view taken along line 7—7 of FIG. 1.

In reference to FIGS. 6 and 7 the "reversibility" and dual "functional" characteristics of the instant invention are illustrated. Specifically, FIG. 6 illustrates finger insert 20 mounted in finger hole 14 such that first finger hole 28 is orientated to be adjacent and generally flush with the exterior surface of ball 10. Alternatively, in reference to FIG. 7, orientation within finger hole 16 of bowling ball 10. It is contemplated that finger insert 20 may be used in any combination of orientations in either finger hole 14 and 16. Additionally, for purposes of the present invention, the thumb is to be construed as a finger, that is, insert 20 is sized for installation within thumb hole 12 of ball 10.

Preferably, insert 20 is made of an elastomeric and resilient material which can be secured within the finger holes provided in a bowling ball. It is contemplated that insert 20 may be permanently secured within a finger hole or may be removably secured therein by any method and materials known to those skilled in the art. Likewise, the insert material should provide a predetermined level of compressibility and deformability to provide comfortable, secure reception of a bowler's finger tip without the risk of "hang-up" upon release of the ball.

Thus, in a simple, yet economical and highly effective manner, the present invention provides a device which achieves a substantial number of beneficial results.

The foregoing discussion discloses and describes merely an exemplary embodiment of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. An insert for a finger hole in a bowling ball, comprising:

a tubular body having an outer wall surface adapted to be inserted into a finger hole of the bowling ball;

said body having an inner wall surface extending substantially coaxial to a central axis of said outer wall surface and defining first and second finger openings at opposite terminal ends of said body which are adapted to receive a fingertip therein;

ridge means extending along the periphery of said inner wall surface adjacent said second finger opening adapted for generating additional gripping force during delivery of the ball; and a finger pad forming a thickened portion of said inner wall surface adjacent said first finger opening adapted for cushioning the fingertip and increasing contact area between the fingertip and the insert as compared to that provided by said ridge means.

2. The insert of claim 1 wherein said tubular body is inserted into the bowling ball such that when said first finger opening is generally flush with an exterior surface of the bowling ball said finger pad engages the fingertip of a bowler, and when said second finger opening is generally flush with an exterior surface of the bowling ball said ridge means is in contact with the fingertip of the bowler.

3. The insert of claim 2 wherein said outer and inner wall surfaces are both substantially cylindrical and concentrically aligned so as to provide said body with a cylindrical wall portion having a substantially uniform cross-sectional thickness.

4. The insert of claim 3 wherein said finger pad is a generally planar frictional surface tapering in thickness from said first finger opening toward said second finger opening so as to blend into said inner wall surface.

5. The insert of claim 4 wherein said finger pad is generally triangular with the base thereof located generally adjacent said first finger opening, and the apex of said triangular finger pad extending toward said second finger opening.

6. The insert of claim 5 wherein said triangular finger pad extends about halfway through said tubular body toward said second finger opening of said body.

7. The insert of claim 6 wherein the thickness of said triangular finger pad is tapered through an angle of about 8° relative to said outer wall surface.

8. The insert of claim 2 wherein said ridge means comprises at least two generally rounded ribs projecting from said inner wall surface in longitudinally spaced relation.

9. The insert of claim 8 wherein said ribs are generally crescent-shaped having a tapered surface portion and a generally rounded edge portion terminating adjacent said inner wall surface.

10. The insert of claim 2 wherein said outer wall surface of said tubular body has an outer diameter of about 31/32 inches so as to be fit interchangeably in standardized finger holes.

11. A set of bowling ball finger inserts as defined in claim 10 wherein said cylindrical inner wall surface of each insert has a different diameter adapted for accommodating fingertips of different sizes.

12. A finger hole insert for a bowling ball, comprising:

an elongated body having a substantially cylindrical outer wall surface adapted for insertion into a finger hole;

said body having a substantially cylindrical inner wall surface defining a central aperture extending substantially coaxial to a central axis of said cylindrical outer wall surface, said aperture defining first and second finger openings on opposite terminal ends of said body adapted to receive a bowler's fingertip therein;

ridge means projecting from said inner wall surface adjacent said second finger opening for increasing the gripping force imparted between the bowler's fingertip and said insert when said second finger hole is adjacent the exterior surface of the bowling ball; and a thickened finger pad formed on said inner wall surface adjacent said first finger opening, said finger pad functioning to cushion a bowler's fingertip and increasing contact area between the fingertip and the insert as compared to that provided by said ridge means when said body is inserted into the finger hole such that said first finger opening is adjacent an exterior surface of the bowling ball;

whereby said finger hole insert has two effective functions depending on the orientation thereof within a finger hole.

13. The insert of claim 12 wherein said outer and inner wall surfaces are concentrically aligned so as to provide said body with a cylindrical wall having a substantially uniform cross-sectional thickness.

14. The insert of claim 12 wherein said finger pad is a generally planar thickened surface tapering in thickness from said first finger opening toward said second finger opening so as to blend into said inner wall surface.

15. The insert of claim 14 wherein said finger pad is generally triangular in configuration with the base thereof integral with the terminal end of said first finger opening, and the apex of said triangular finger pad extending toward said second finger opening.

16. The insert of claim 12 wherein said ridge means comprises at least two ribs projecting from said inner wall surface in longitudinally spaced relation.

17. The insert of claim 16 wherein said ribs are generally crescent-shaped having a tapered surface portion and a generally rounded edge portion terminating adjacent said inner wall surface.

18. The insert of claim 12 wherein said body is an injection molded member fabricated of a relatively resilient material.

19. A bowling ball assembly, comprising:

a bowling ball having at least one finger hole;

a resilient insert disposed within said finger hole;

said insert having an inner wall surface defining an aperture extending substantially parallel to a central axis of said insert, said aperture extending through said insert to define first and second finger openings on opposite terminal ends thereof sized to receive a bowler's finger therein;

said insert having a plurality of ribs projecting from said inner wall surface adjacent said second finger opening and a thickened finger pad formed on a portion of said inner wall surface adjacent said first finger opening for cushioning the fingertip and increasing contact area between the fingertip and the insert as compared to that provided by said ridge means;

wherein said insert may be disposed in said finger hole either said first or second finger opening adjacent an external surface of said bowling ball.

20. The bowling ball assembly according to claim 19 wherein an outer wall surface of said insert and said inner wall surface are concentrically aligned so as to provide said insert with a cylindrical wall having a substantially uniform wall thickness.

21. The bowling ball assembly according to claim 20 wherein said finger pad is a generally planar frictional surface having a thickened portion adjacent the terminal end of said first finger opening, said thickened portion generally tapering in thickness from said first finger opening toward said second finger opening so as to blend into said inner wall surface.

22. The bowling ball assembly according to claim 21 wherein said finger pad is generally triangular in configuration having its base defining a portion of the terminal end associated with said first finger opening, and its apex extending toward said second finger opening and terminating by blending into said inner wall surface.

23. The bowling ball assembly according to claim 22 wherein said ribs project from said inner wall surface in longitudinally spaced relation and extend around the periphery thereof, said ribs having a generally rounded contour.

24. A series of inserts for use in finger holes of a bowling ball, comprising:

a plurality of resilient tubular bodies each having a continuous outer wall surface defining a generally cylindrical shape and each being substantially equal in diameter to said other bodies to enable said bodies to be fit interchangeably in different finger holes having a corresponding diameter;

each resilient body having a generally cylindrical inner wall surface extending therethrough defining first and second finger openings on opposite terminal ends of said inserts, wherein said inner wall surface associated with each body is of a different diameter to accommodate fingertips of different sizes; said second finger opening of each resilient body having ridge means extending substantially along the periphery of said inner wall surface adjacent said second finger opening adapted for generating additional gripping force during delivery of the bowling ball; and said first finger opening of each resilient body having a finger pad forming a thickened planar surface on a portion of said inner wall surface adapted for cushioning the bowler's fingertip and increasing contact area between the fingertip and the insert as compared to that provided by said ridge means.

25. The series of inserts according to claim 24 wherein the inner wall surface diameter of said resilient bodies range between about 19/32" and 29/32".

26. The series of inserts according to claim 25 wherein said ridge means comprises at least two ribs projecting from said inner wall surface in longitudinally spaced relation, said ribs being generally crescent-shaped having a tapered surface portion and a generally rounded edge portion terminating adjacent said inner wall surface.

* * * * *

UNITED STATES PATENT AND TRADEMARK OFFICE

CERTIFICATE OF CORRECTION

PATENT NO. : 5,002,276

DATED : March 26, 1991

INVENTOR(S) : David A. Bernhardt

It is certified that error appears in the above-identified patent and that said Letters Patent is hereby corrected as shown below:

Title Page under "Other Publications" "Manufactures" should be --Manufacturers--

Column 1, line 48, "a" should be --an--

Column 4, line 7, after "7" insert --finger insert 20 is illustrated installed in a "reversed"--

Column 6, line 34, after "hole" insert --with--

Column 7, line 5, begin new paragraph with "said second finger opening..."

Column 8, line 4, "diameter" should be --diameters--

Signed and Sealed this

Twentieth Day of October, 1992

*Attest:*

DOUGLAS B. COMER

*Attesting Officer*

*Acting Commissioner of Patents and Trademarks*